United States Patent [19]

Tsai

[11] Patent Number: 4,792,436

[45] Date of Patent: Dec. 20, 1988

[54] HYDROCARBON CONVERTER FURNACE

[75] Inventor: Frank W. Tsai, San Marino, Calif.

[73] Assignee: Kinetics Technology International, Monrovia, Calif.

[21] Appl. No.: 47,210

[22] Filed: May 8, 1987

[51] Int. Cl.[4] ..... C10G 9/20

[52] U.S. Cl. ..... 422/111; 48/94; 196/110; 196/127; 196/132; 196/135; 422/197

[58] Field of Search ..... 196/110, 127, 132, 155, 196/135; 422/197, 111, 110, 204, 312; 208/48 R, DIG. 1; 48/94; 585/950, 922, 923, 911, 956; 138/45, 46; 251/124; 122/406 B, 448 R, 448 S, DIG. 15

[56] References Cited

U.S. PATENT DOCUMENTS

| | | | |
|---|---|---|---|
| 3,117,620 | 1/1964 | Fuller | 122/406 B |
| 3,268,435 | 8/1966 | Sellin | 196/127 |
| 3,271,472 | 9/1966 | Ogle et al. | 196/132 |
| 3,671,198 | 6/1972 | Wallace | 422/204 |
| 3,952,776 | 4/1976 | Eversole et al. | 138/45 |
| 4,194,966 | 3/1980 | Edison et al. | 196/110 |

FOREIGN PATENT DOCUMENTS

| | | | |
|---|---|---|---|
| 2126118 | 3/1984 | United Kingdom | 422/197 |

*Primary Examiner*—David L. Lacey
*Assistant Examiner*—Joye L. Woodard
*Attorney, Agent, or Firm*—William W. Haefliger

[57] ABSTRACT

A hydrocarbon converter furnace has an upper convection heating zone and a lower radiant heating zone, and tubing extends in those zones to convey a fluid hydrocarbon feed and steam in sequence through the convection and radiant heating zones. The tubing includes a feed section and branches therefrom in the radiant section of the furnace, the feed section and branches arranged so that the hydrocarbon and steam flow from the feed section to said branches; also provided is valving for controlling the relative rates of flow in the branches to reduce differential coking in the branches.

6 Claims, 7 Drawing Sheets

HP STEAM
32,000 LBS/HR
650 PSIG
750°F
69
BFW
33,700 LBS/HR.
235°F
62
690 PSIG
LP STEAM
63
400 LBS/HR
35 PSIG
280°F
BLOWDOWN
1300 LBS/HR
CRACKED GAS
19
8 PSIG
525°F
60
670 PSIG
500°F
64
65
68
18
11b
12b
17
10 PSIG
1600°F
11a
61
12a
68a
14
210°F
16a
16
15a
60 PSIG
100°F
280°F
510°F
90
60 PSIG
340°F
1250°F
16d
16c
16b'
20
16c
16b
15
N.G. FUEL
70,000 SCF/HR
60°F
13
11
10
FEED
20,000 LBS/HR.
DILUTION
STEAM
6,000 LBS/HR

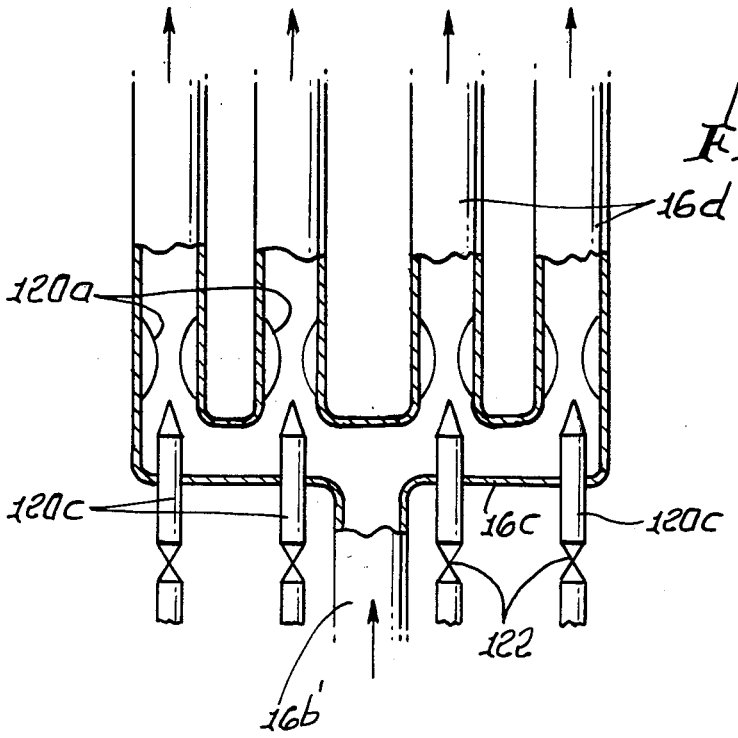
FIG. 5.
FIG. 12.
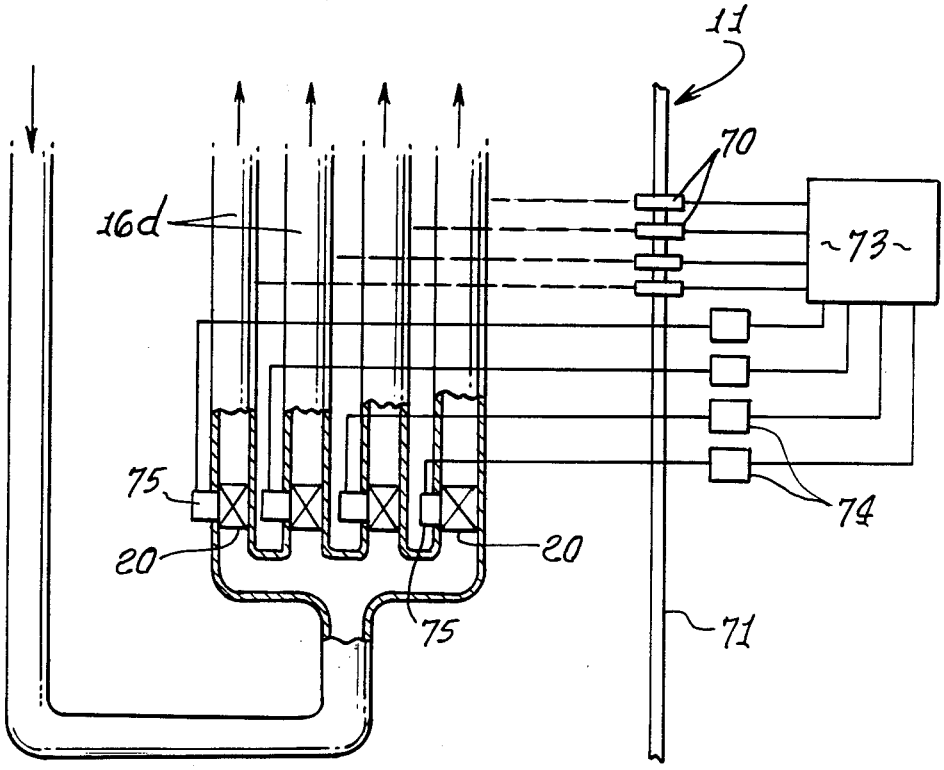

HYDROCARBON CONVERTER FURNACE

BACKGROUND OF THE INVENTION

This invention relates generally to hydrocarbon pyrolysis, producing olefins, for example; and more particularly it concerns improvements in reaction tube configurations in such processes, leading to reduced coking.

In hydrocarbon pyrolysis, the primary products are typically olefins. They are favored by reactions with short hydrocarbon residence time, in the reactor, and low hydrocarbon partial pressure. To achieve these conditions, the reactor volume, and thus residence time, must be minimized, whereby reaction tubing is required. The reactor volume of tubular type is determined by its length and diameter.

In pyrolysis, there are two important considerations: the conversion of feedstock and the olefins selectivity. The extent of conversion measures the destruction i.e. reforming of the feedstock, and the olefins selectivity indicates the efficiency of the production of olefins from the destroyed feedstock.

The most efficient tubular reactor is a coil consisting of a single tube having small diameter, such a single tube reactor providing short residence time and low hydrocarbon partial pressure. Consequently, a high olefins selectivity is obtained. The disadvantage of a single tube reactor is that the capacity is low. A large number of coils is therfore needed for a given capacity of furnace, which makes the furnace more costly. In this regard, it is believed in the past that the flow in coil tubing in a convection heating section of the furnace should be slower than flow in tubing in a radiant heating section of the furnace. Such coils tend to "coke-up" in use, reducing their effectiveness, and olefin yield, and the larger the number of coils employed, the greater the coking problem due to changes in heating resulting from coil position in the furnace. A solution to these problems, prior to the present invention was not known.

SUMMARY OF THE INVENTION

It is a major object of the invention to provide a hydrocarbon converter furnace containing pyrolysis tubing of a configuration overcoming the above problems and difficulties. Basically, a typical furnace has an upper convection heating zone and a lower radiant heating zone, with tubing extending in those two zones to convey a fluid hydrocarbon feed and steam in sequence through those zones to be heated to successively higher temperatures. The tubing includes a feed section and branches from the feed section, in the radiant heating zone, and arranged so that the feed flows to the branches so as to reduce or prevent coke formation in the branches, and to maintain desirably high olefin yield. As described above, coke, i.e. carbon formation, tends to plug the tubing and reduce or prevent flow in the tubing. Typically, the branch tubes extend generally upright in the path of hot combustion gases in the radiant, i.e. lower, heating zone of the furnace, and the tubing feed section includes a downcomer together with a U-shaped section both extending in the radiant zone and via which hot feed hydrocarbon and steam are fed to the branches wherein the reaction takes place at controlled high temperature, above 1,200° F., producing olefins.

In this environment, valve means may typically include control valves in the branches, for example with separately movable stoppers for increasing or decreasing the flow rates of hydrocarbons and steam in the main extents of such branches in the radiant section; and the valves are preferably located proximate connections of the branches with the tubing feed section or sections. There are typically multiple such branches, i.e. preferably four; however, the usable numbers are two, three, six, eight, twelve, sixteen, etc., i.e. multiples of two or three. The valves preferably have venturi-shaped throats and their stoppers are movable axially in such throats. Actuators for the stoppers may have movable members extending in the hot radiant section of the furnace. The objective it to achieve even or equalized flow of feed in the branches regardless of their positions in the furnace radiant section.

A further object is to provide sensors for sensing the temperatures of the branches downstream of said valves, and operatively connected in controlling relation with the actuators to cause the actuators to increase the openings of said valves in response to increasing temperature of said branches, whereby increased flow of hydrocarbon in the branches effects increased cooling thereof. In this way, very effective cooling control, to prevent coking, is achieved.

These and other objects and advantages of the invention, as well as the details of an illustrative embodiment, will be more fully understood from the following specification and drawings, in which:

DRAWING DESCRIPTION

FIG. 5 is a view like FIG. 4, showing stoppers defining nozzle injection means;

FIG. 12 is a view like FIG. 3, showing temperature control of valve actuators, in tubing branches.

DETAILED DESCRIPTION

Figure 1:
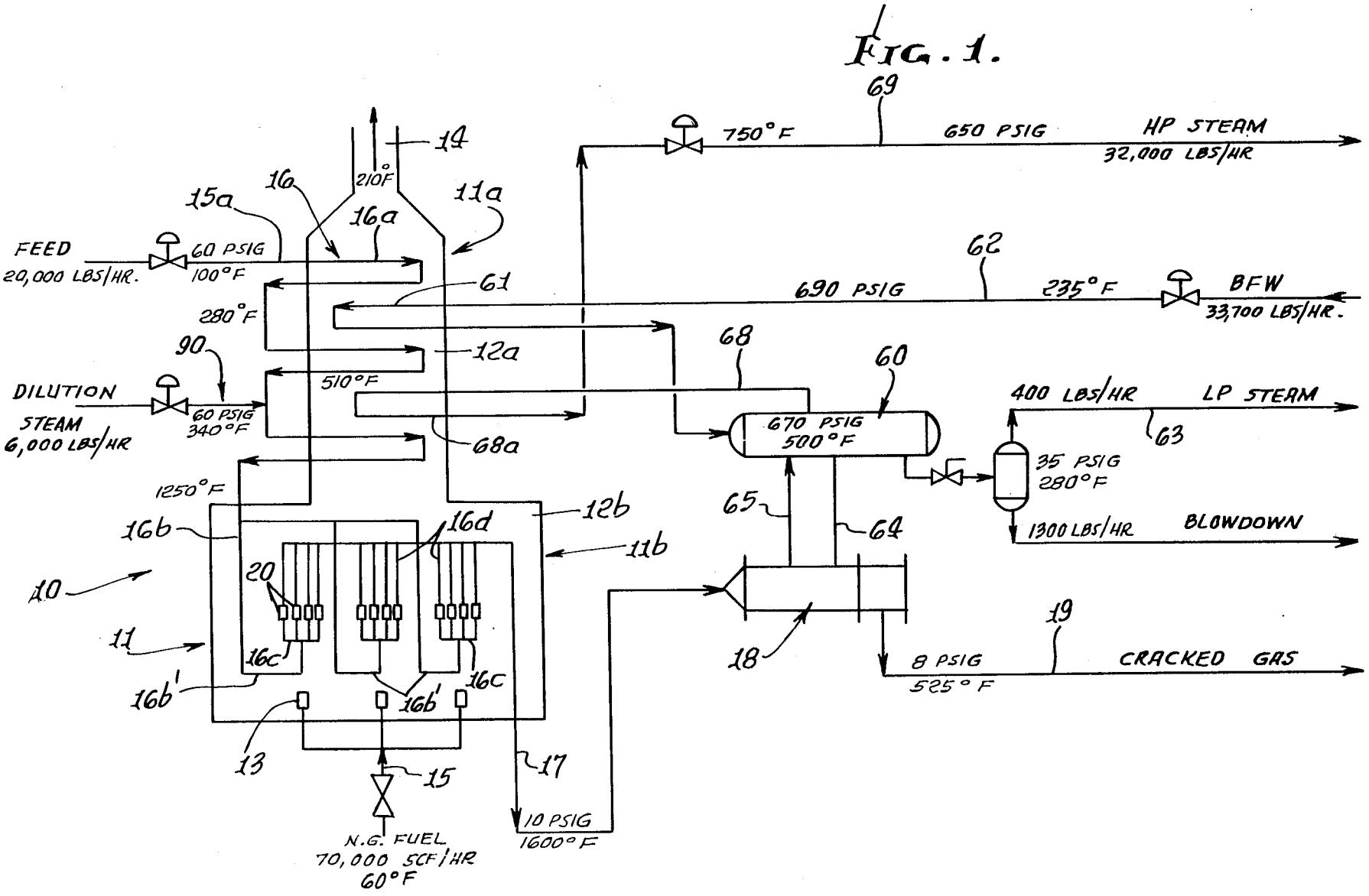
FIG. 1 is a process flow diagram.
Figure 2:
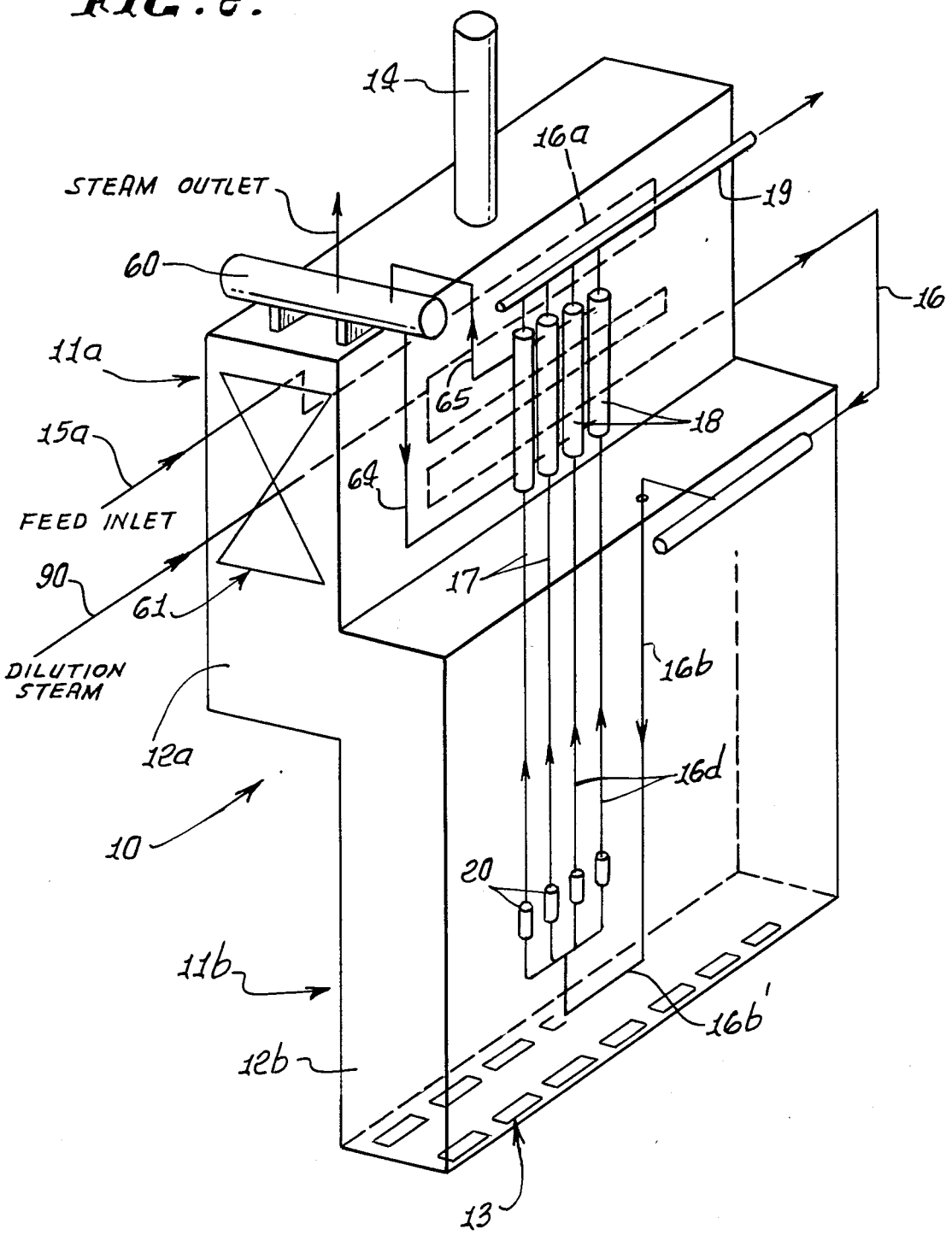
FIG. 2 is a perspective schematic view of a pyrolysis furnace embodying the invention.

In FIGS. 1 and 2, a pyrolysis furnace 10 includes a furnace chamber 11 having an upper convection section **11*a* and a lower radiant section 11*b*. Section 11*a* defines an upper, interior, convection heating zone 12*a*, and section 11*b* defines a lower, interior, radiant heating zone 12*b*. Burners 13 at the lower end of zone 12*b* provide flames and hot combustion gases rising in zone 12*b*, and the gases then pass upwardly through convection heating zone 12*a* to discharge via stack 14. Combustion gas is fed at 15** to the burners, and air is also admitted to the burners, as is conventional.

A hydrocarbon feed is passed at 15a to the furnace via metallic tubing 16, which extends in zones 12a and 12b to convey the feed in sequence through 12a, wherein the feed is preheated, and through radiant heating zone 12b, wherein the feed is further heated to reaction, i.e. olefin production, temperatures. Typical approximate usable temperatures and pressures are designated in FIG. 1, but these may vary. Dilution steam is added to the hydrocabon flow at 90.

The tubing 16 includes coil section 16a in zone 12a, and connecting with feed section of tubing 16b in the radiant zone 12b. Section 16b may advantageously comprise a downcomer connecting with a U-shaped sections 16b' in the lower portion of zone 12b. Connected with the rising portions of sections 16b' are tubing branches 16d to which the hydrocarbon feed flows, as via manifolds 16c. See also FIG. 3. The branches typically extend upright in the path of hot combustion gases in the radiant heating zone 12b of the furnace; however, the arrangement may be inverted. Effluent from the branches, containing olefin, passes at 17 to quench heat exchanger or exchangers 18 (for example TLE or transfer line exchanger). The latter are typically located outside the furnace, and discharge olefins to the heater 19.

Also in accordance with the invention, valve means is provided for use in the hydrocarbon converter furnace, the valve means controlling the relative rates of flow in said branches 16d in order to reduce differential coking in said branches, which might otherwise result due to differential heating of the branches caused by their different locations in the furnace.

The valve means typically includes control valves 20 in the branches, near their lower inlet ends, the valves having separately movable stoppers for increasing or decreasing the flow rates of hydrocarbons and steam in the main extents of the branches in the radiant section. Such controllable valves enable adjustment of flow among the parallel branches to prevent uneven coking during endothermic hydrocarbon cracking, to produce a higher yield of olefin. In this regard, the feed may comprise naptha, gas oil, propane, crude oil, LPG and other hydrocarbons.

Figure 4:
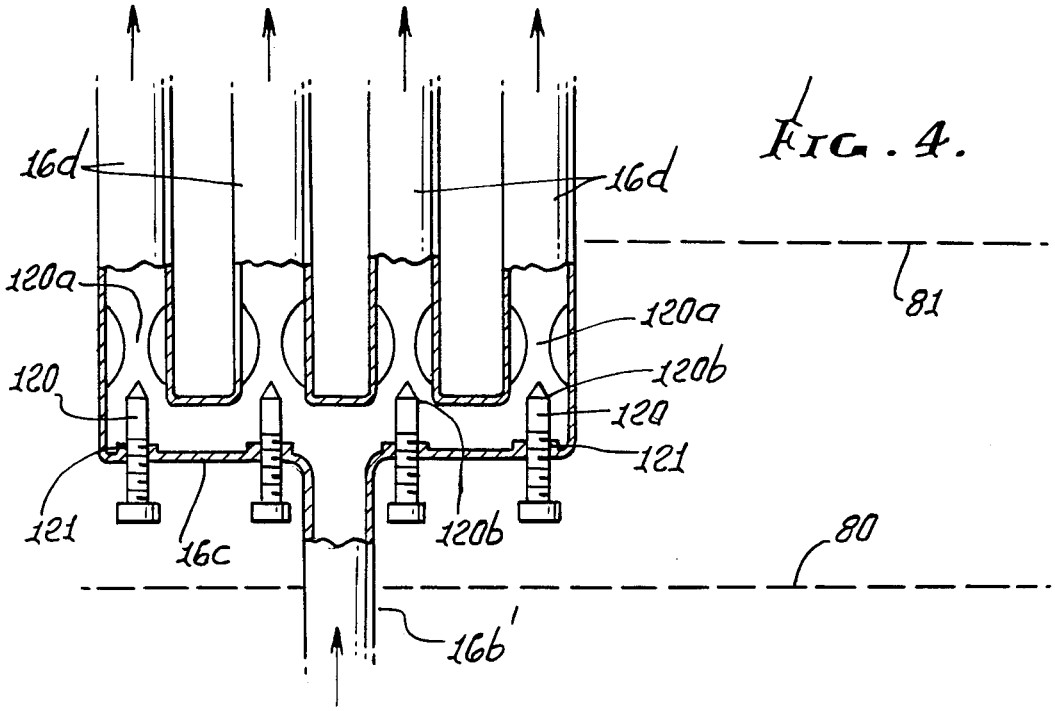
FIG. 4 is a view like FIG. 3, showing flow adjustment.

Turning to FIG. 4, separately adjustable screw type valves are shown at 120, having ports 120a and stem type stoppers 120b controlling the ports. The stoppers have screw threaded attachment at 121 with the tubing structure, and may be rotatably advanced and retracted to enlarge or reduce the sizes of the ports at the lower ends of tubing sections 16d. The ports are shown as having venturi shape, for maximum (i.e. 85–90%) pressure recovery. In FIG. 5, the elements are the same as in FIG. 4, and in addition, the stoppers 120c that are axially movable also define nozzles, i.e., are tubular, to inject dilution steam into the hydrocarbon and steam feed, at the port locations. Note steam flow control valves 122 in series with the nozzles, such valves being separately adjustable. Such steam injection minimizes need for dilution steam injection into the tubing section 16a, as indicated in FIG. 1. The steam injection also provides additional flow adjustment and pressure reduction in the branches 16d, to minimize differential coking.

Figure 3:
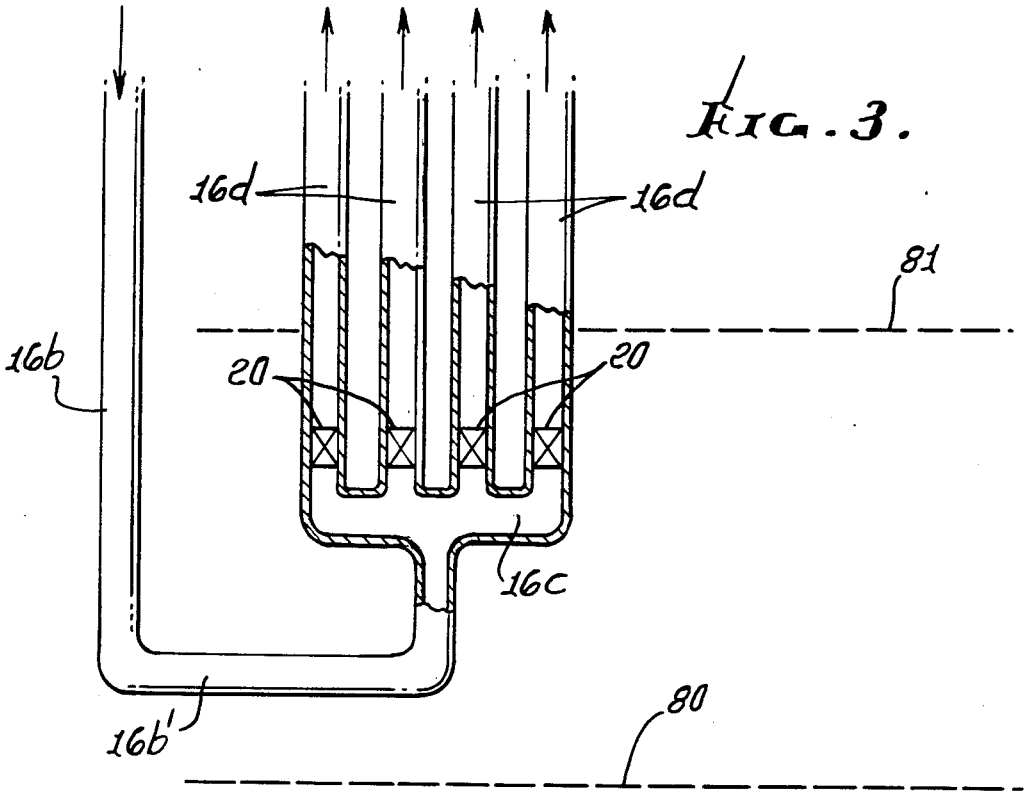
FIG. 3 is a diagrammatic view of tubing embodying the invention.
Figure 7:
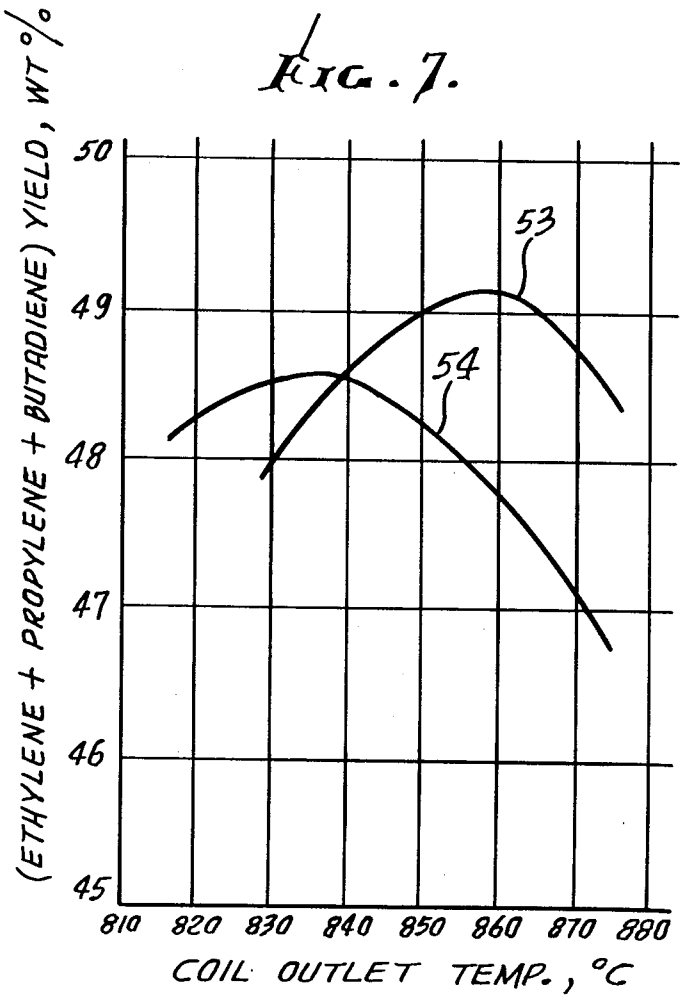
FIG. 7 is a graph of coil outlet temperature vs (ethylene and propylene and butadiene) yield, wt. %.
Figure 6:
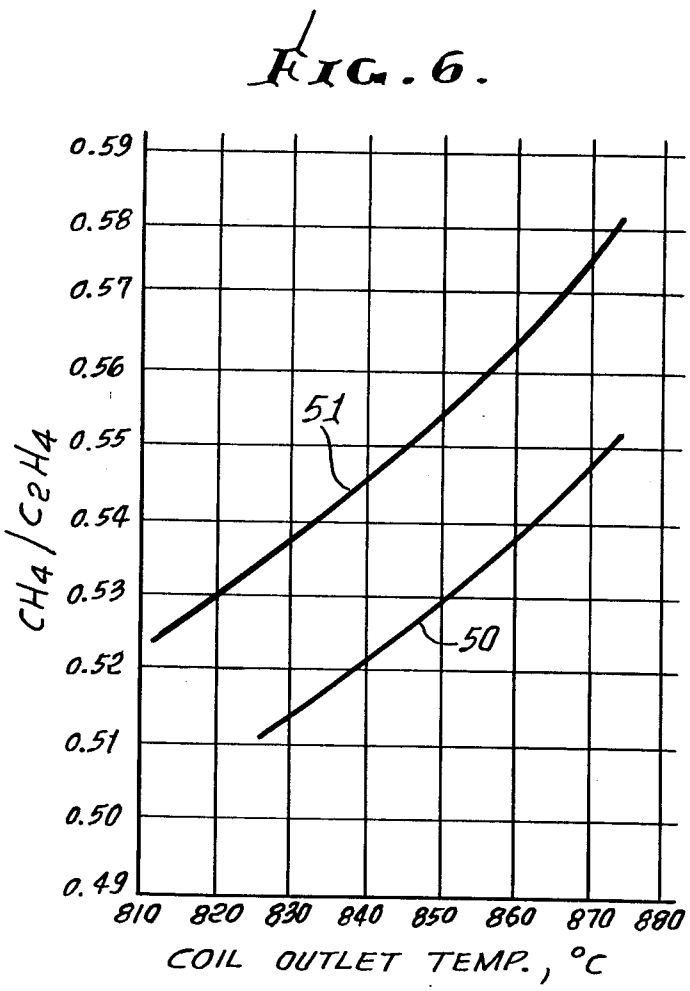
FIG. 6 is a graph of coil outlet temperature vs $CH_4/C_2H_4$.
Figure 9:
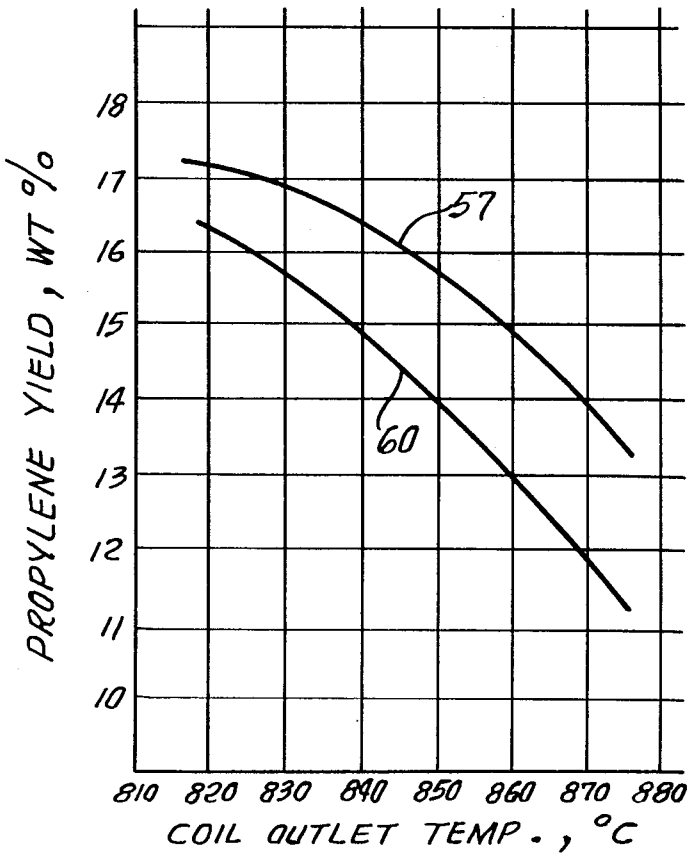
FIG. 9 is a graph of coil outlet temperature vs propylene yield, wt. %.
Figure 8:
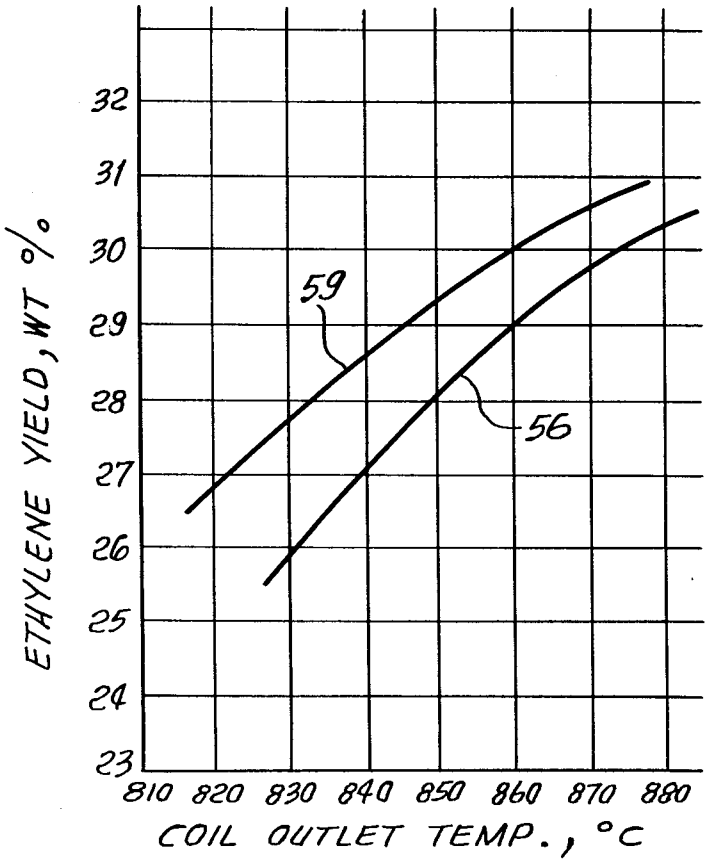
FIG. 8 is a graph of coil outlet temperature vs ethylene yield, wt. %.
Figure 11:
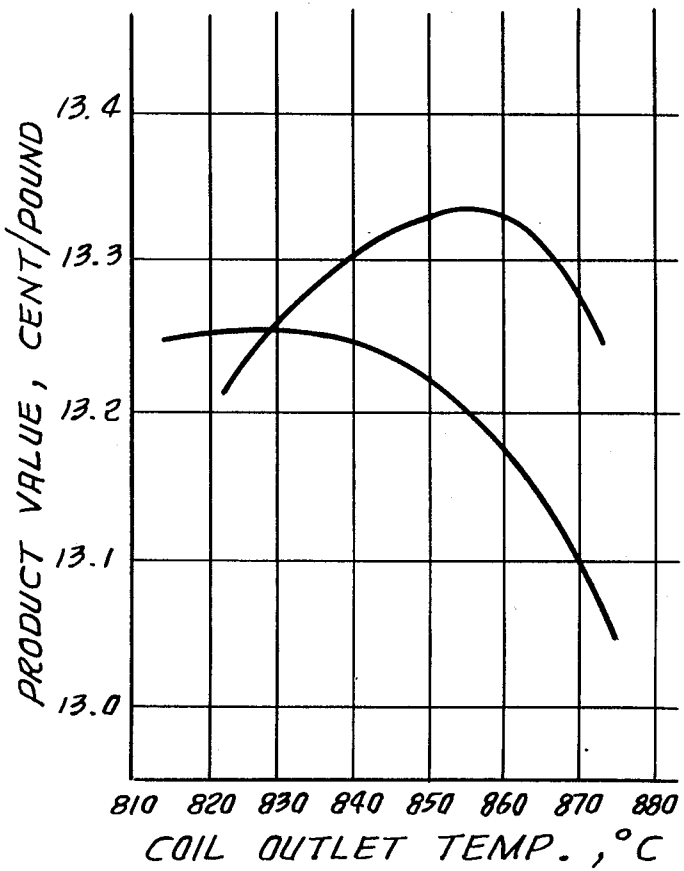
FIG. 11 is a graph of coil outlet temperature vs product valve, cent/lb.
Figure 10:
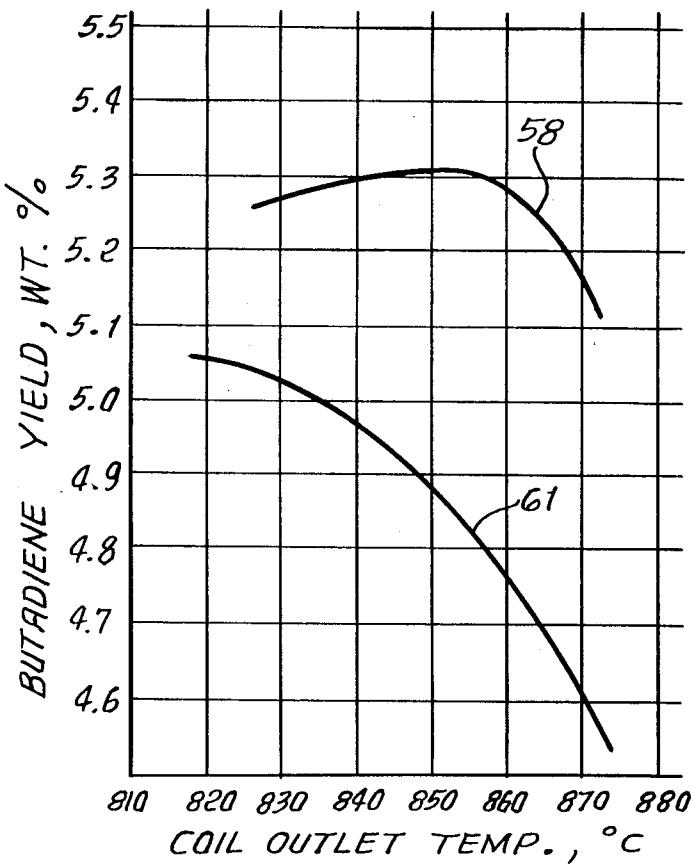
FIG. 10 is a graph of coil outlet temperature vs butadiene yield, wt. %.

Methane/ethylene ratio as a function of branch coil outlet temperature for the FIGS. 2 and 3 apparatus is shown by curve 50 in FIG. 6. A similar curve 51 is applicable to a prior design not employing branch lines 16d (four tubing sections in the convection section feeding hydrocarbon to one tube in the radiant section). FIG. 7 indicates total olefin yield (curve 53) as a function of coil outlet temperature, for the FIGS. 2 and 3, apparatus, and curve 54 applies to said prior design. FIGS. 8, 9 and 10 illustrate other olefin component yield curves 56, 57 and 58 for the FIGS. 2 and 3 apparatus, compared with yield curves 59–61 for the described prior apparatus.

The following TABLE gives comparative yields for the prior and present pyrolysis coils. In these coils, the tubing inner diameter remain substantially the same, throughout, and may be about two inches.

TABLE

YIELD COMPARISON

| | ¢/# | PRIOR* (4 to 1) | FIGS. 2 & 3 Apparatus |
|---|---|---|---|
| COT, °C. (coil outlet temperature) | | 837 | 856 |
| Residence Time, Seconds | | 0.202 | 0.244 |
| | | Yield, WT % | |
| $H_2$ | 12 | 0.90 | 0.91 |
| $CH_4$ | 7 | 15.42 | 15.29 |
| $C_2H_2$ | 14 | 0.41 | 0.51 |
| $C_2H_4$ | 18 | 28.36 | 28.60 |
| $C_2H_6$ | 10 | 3.67 | 3.82 |
| $C_3H_4$ | 10 | 0.61 | 0.71 |
| $C_3H_6$ | 14 | 15.25 | 15.26 |
| $C_3H_8$ | 10 | 0.42 | 0.41 |
| $C_4H_6$ | 22 | 5.00 | 5.30 |
| $C_4H_8$ | 12 | 4.22 | 4.19 |
| $C_4H_{10}$ | 10 | 0.59 | 0.56 |
| $C_5$/200° C. A | 12 | 14.72 | 14.37 |
| $C_5$/200°-NA | 10 | 6.18 | 5.93 |
| 200° C. | 6 | 4.12 | 4.00 |
| Total Olefins, Wt % | | 48.61 | 49.16 |
| $CH_4/C_2H_4$ Selectivity | | 0.534 | 0.535 |
| Product Value, ¢/# | | 13.252 | 13.312 |

*see curve 51 in FIG. 6

FIGS. 1 and 2 also show a steam drum 60 to which boiler feed steam is fed from a coil 61 in the furnace zone 12a, boiler feed water being fed at 62 to that coil. Useful low pressure steam is drawn from the drum at 63; and steam from the drum in line 68 is again heated at 68a in zone 12a, for supply as useful superheated high pressure steam, at 69. Water condensate from the drum is fed at 64 to the exchanger or exchangers 18, and returned at 65 as steam, to the drum.

Another object of the invention concerns the provision of valve stopper actuators, and sensors for sensing the temperatures of said branches downstream of the valves, and operatively connected in controlling relation with the actuators to cause the actuators to automatically increase the openings of such valves in response to increasing temperatures of said branches, whereby increased flow of hydrocarbon and steam in the branches effects increased cooling thereof. As shown in FIG. 12, heat sensors such as optical pyrometers 70 at the furnace wall 71 are directed at the branches 16d, within which the hydrocarbon is being converted. Electrical outputs of the pyrometers, proportional to temperature, are received by the controller 73, which controls the drives 74 for the valve actuators 75. As a result, the branches are kept from overheating, and differential coking is prevented or minimized.

In FIGS. 3 and 4, the floor of the furnace may be located as at 80, entirely below the branches 16d and valves 20 (or 120), or the floor may be located above the levels of the valves, as at 81. In the latter event, the valves are outside the furnace, and may be operated at cooler temperatures.

I claim:

1. A hydrocarbon converter furnace having an upper convection heating section and a lower radiant heating section, and tubing extending through said sections to convey a fluid hydrocarbon feed and steam in sequence through the convection and radiant heating sections, wherein the tubing comprises:

(a) a common feed section and multiple branches extending therefrom in the radiant section of the furnace, each of said branches having an inlet in fluid communication with the feed section so that hydrocarbon and steam flow from the feed section into each of said branches, (b) valve means in each of said branches for controlling the rates of flow of hydrocarbon and steam in said branches to reduce differential coking therein, (c) said branches extending generally upright in and relative to said radiant heating section of the furnace, the feed section including a downcomer and a U-shaped section, both extending in said radiant section of the furnace and through which hot feed hydrocarbon and steam are fed upwardly to said branches, (d) said branches having main extents in said radiant section, and said valve means including control valves in each of said branches having an opening and having separately movable stoppers movable lengthwise of and within the branches for increasing or decreasing the flow rates of hydrocarbon and steam through the opening of the control values in the main extents of said branches in said radiant section, (e) said stoppers including nozzle means for controllably introducing dilution steam therethrough into the branches, said nozzle means including separately adjustable valves to separately control the amount of dilution steam fed to each of said branches through the nozzle means of each stopper to thereby minimize differential coking in the branches.

2. The furnace of claim 1 wherein the control valves have venturi-shaped throats and the stoppers are movable axially in such throats.

3. The furnace of claim 1 wherein there are four of said branches extending from the feed section.

4. The furnace of claim 1 including actuators connected to each of the stoppers for moving said stoppers.

5. The furnace of claim 4 including sensors for sensing the temperatures of said branches downstream of said valves, and operatively connected in controlling relation with said actuators to cause the actuators and the stoppers to move and increase the openings of said valves in response to increasing temperatures of said branches, whereby increased flow of hydrocarbon and steam in the branches effects increased cooling thereof.

6. The furnace of claim 1 including heat exchanger means connected to said branches externally of the furnace for quenching effluent flow from said branches, and for recovery of heat.

* * * * *